US008468812B1

(12) United States Patent
Banks, III

(10) Patent No.: US 8,468,812 B1
(45) Date of Patent: Jun. 25, 2013

(54) EXHAUST SCAVENGING SYSTEM

(76) Inventor: Gale C. Banks, III, Bradbury, CA (US)

( * ) Notice: Subject to any disclaimer, the term of this patent is extended or adjusted under 35 U.S.C. 154(b) by 124 days.

(21) Appl. No.: 13/278,059

(22) Filed: Oct. 20, 2011

(51) Int. Cl.
*F01N 1/00* (2006.01)

(52) U.S. Cl.
USPC ..... 60/323

(58) Field of Classification Search
USPC ..... 60/323, 324
See application file for complete search history.

(56) References Cited

U.S. PATENT DOCUMENTS

| | | | | | |
|---|---|---|---|---|---|
| 2,455,493 | A | * | 12/1948 | Jacobs | 60/321 |
| 3,470,690 | A | * | 10/1969 | Thompson | 60/303 |
| 3,491,534 | A | | 1/1970 | Garner | |
| 3,507,301 | A | | 4/1970 | Larson | |
| 4,159,627 | A | * | 7/1979 | Monch et al. | 60/322 |
| 4,796,426 | A | | 1/1989 | Feuling | |
| 5,216,883 | A | | 6/1993 | Flugger | |
| 5,248,859 | A | * | 9/1993 | Borla | 181/238 |
| 5,299,419 | A | | 4/1994 | Bittle et al. | |
| 5,678,404 | A | | 10/1997 | McManus | |
| 5,765,373 | A | | 6/1998 | Bittle et al. | |
| 5,816,045 | A | * | 10/1998 | Blocker et al. | 60/323 |
| 6,555,070 | B1 | * | 4/2003 | Kruger | 422/179 |
| 6,634,171 | B1 | | 10/2003 | Banks, III | |
| 6,837,044 | B2 | * | 1/2005 | Kobayashi et al. | 60/323 |
| 2010/0146956 | A1 | * | 6/2010 | Grudynski, III | 60/324 |
| 2011/0154812 | A1 | * | 6/2011 | Butler | 60/324 |

FOREIGN PATENT DOCUMENTS

| | | |
|---|---|---|
| EP | 0284466 | 9/1988 |
| JP | 60-088816 | 5/1985 |

* cited by examiner

*Primary Examiner* — Thomas Denion
*Assistant Examiner* — Jason Shanske
(74) *Attorney, Agent, or Firm* — Novak Druce Connolly Bove + Quigg LLP

(57) ABSTRACT

An exhaust scavenging system for an internal combustion engine including exhaust passages extending from the engine and an exhaust outlet system. A collector extends from the bundled ends of the exhaust passages to the exhaust outlet system. A central exhaust passage extends into the collector from a central position among the bundled exhaust passage outlets. The transverse cross-sectional area of the central exhaust passage through at least half of the transition collector portion from the outlet plane is not substantially less than the transverse cross-sectional area of the central exhaust passage at the outlet plane in the extended position and does decrease continuously through the transition collector portion from the outlet plane in the retracted position.

5 Claims, 5 Drawing Sheets

EXHAUST SCAVENGING SYSTEM

BACKGROUND OF THE INVENTION

The field of the present invention is exhaust systems for variable volume internal combustion engines.

Variable volume internal combustion engines are most commonly Otto cycle or diesel cycle engines. Each typically employs an exhaust scavenging system for directing the exhaust from these engines away from the engine and to a common exhaust outlet system. Scavenging systems include individual exhaust passages extending from a bank of cylinders and converging to a bundle at the outlets from the exhaust passages. Exhaust outlet systems typically include a singular tube to receive flow from the bundle of exhaust passages. Collectors transition between the exhaust scavenging systems and the exhaust outlet systems.

In directing the exhaust away from the engine, such scavenging systems have long been designed to reduce restrictions which compromise airflow through the engine. Resistance to airflow raises exhaust port pressures and reduces engine efficiency. Designs also attempt to enhance performance through tuning of the lengths of the exhaust passages. Tuning is possible because the exhaust exits the engine in the form of pulses from each cylinder. The pressure waves associated with this pulsing can be utilized to aid in the timed reduction of pressure. Such systems take advantage of a rarefaction wave that follows the pressure wave to sequentially reduce the exhaust port pressure for the next exhausting cylinder.

A collector is used to transition the flow from the separately tuned exhaust passages to a common exhaust outlet system. Collectors typically have one end extending about the collected exhaust passages. As the exhaust passages are typically cylindrical pipe, they are brought together in a circular pattern with each exhaust passage touching two adjacent exhaust passages. The end of the collector is, therefore, scalloped to accommodate each of the pipes in order to form the seal. The ridges and valleys of the collector at this scalloped end extend toward the other end of the collector but transition slowly to a circular configuration for interfacing with the singular tube of the exhaust outlet system.

Traditionally, a plate to block off the center space defined by the circularly arranged tubes is welded in place. This arrangement creates an obvious discontinuity in the flow path at the exhaust passage exit. Efforts have been made to provide a smooth transition from the exhaust passages into the collector by using an aerodynamic trailing surface such as a pyramidal structure with the base covering the center space and the apex extending some distance axially into the collector. Two such devices are illustrated in U.S. Pat. No. 3,507,301 and U.S. Pat. No. 5,765,373.

In U.S. Pat. No. 6,634,171, the disclosure of which is incorporated herein by reference, exhaust passages extend from the engine and include outlets bundled substantially at an outlet plane. A collector includes an inlet portion extending about the bundled exhaust passages, an outlet portion configured to interface with the singular tube of an exhaust outlet system and a transition portion there between defining a flow transition between the inlet and outlet portions. A flow enhancement element is centered at the bundled exhaust passage outlets and extends into the transition portion of the collector. The flow enhancement element advantageously affects exhaust flow through the system.

The flow enhancement element of the exhaust scavenging system in U.S. Pat. No. 6,634,171 includes a transverse cross-sectional area which, through at least half of the transition collector portion from the outlet plane, is not substantially less than the transverse cross-sectional area of the flow at the outlet plane when the enhancement element is in the extended position. This retention of size may be maintained even though the overall cross-sectional flow path within the collector may be decreasing toward an interface with the exhaust outlet system.

The exhaust outlet system to which the collector interfaces typically includes a single tube extending to a remote release such as the exhaust pipe of a vehicle. Devices are typically included with such exhaust outlet systems such as sound attenuating devices, pollutant converting devices and even turbochargers. On specialty uses, a simple short tube may define the exhaust outlet system. When an engine has more than one bank of cylinders, each bank includes exhaust passages extending to a collector for each bank. The exhaust tubes from the collectors often merge well downstream of the collectors to share the exhaust devices.

In operation, when an exhaust valve of a multi-valve engine opens to relieve the gases of combustion, the associated piston of that engine moves upwardly to fully exhaust the cylinder. This exhaust pulse then moves through the system to atmosphere. The exhaust valve is usually timed to open somewhat before the piston reaches the bottom of its power stroke and before the actual exhaust stroke. The combustion within the cylinder is nearing completion at this time but is still expanding. Upon the opening of the exhaust valve, the hot expanding gases rush into the exhaust port and continue to flow out of the cylinder. Pressure is reduced within the cylinder and the piston rises up to push the remaining combusted gas out until the exhaust valve closes. Depending on the settings of the engine, this valve closure will occur slightly before to slightly after the piston reaches the top of its stroke.

If the exhaust from the open exhaust valve enters a length of exhaust passage, it will travel down the passage as a high-pressure pulse, sometimes referred to as an energy slug, to exit at atmospheric pressure. When the exhaust valve closes, the flow from the cylinder stops but inertia continues the flow of the exhaust pulse toward the outlet. As the exhaust pulse moves down the passage away from the closed exhaust valve, pressure is reduced in the area behind the moving pulse to a level below atmospheric pressure.

If the aforementioned exhaust passage exits into a collection chamber that is larger, the tail end of the high pressure exhaust pulse will expand and slow down as it enters this chamber. As the exhaust pulse passes through the outlet of the collection chamber into the secondary piping, another sub-atmospheric pressure pulse is created in the collection chamber behind the exiting high-pressure exhaust pulse.

If primary exhaust passages from other cylinders of a multi-cylinder engine enter the collection chamber, the sub-atmospheric pulse from one primary passage exiting the chamber will cause a reverse direction pulse in any other primary passages entering the collection chamber. By sizing the length and diameter of the manifold passages in relation to a given engine speed range, the arrival of this low-pressure pulse can be timed so that it arrives as the exhaust valve of another cylinder opens. The presence of this low-pressure area generated by the prior valve closure and ahead of the high-pressure pulse to be leaving the opening of the next exhaust valve will aid in the flow, or scavenging, of the high-pressure pulse from the cylinder. If the low-pressure pulse is present during the overlap period when both exhaust and intake valves are partially open, the pulse will assist in drawing intake air across and through the combustion chamber. The column inertia of this flow will further increase the volumetric efficiency of the cylinder.

The shape and the volume of the collection chamber, or collector, plays an important role in the effect of the low-pressure pulse on the primary passages from other cylinders. As the volume of the collector is reduced, the low-pressure pulse leaving one of the primary passages will have a greater influence in lowering the pressure in the other primary passages entering the collector. For tuning to lower engine speeds, other conditions remaining the same, the collector volume is smaller to maintain the exhaust gas velocity needed to produce a strong influence of the low-pressure pulse on the other exhaust passages entering the collector.

Because the high and low-pressure pulses must travel over a distance through the passages and occur at varying frequencies as the engine speed is changed, the most noticeable scavenging effect will occur within a specific speed range of the engine for a given exhaust manifold configuration. The lengths of the primary passages are normally made equal, and established to maximize the scavenging effect within a desired engine speed range. Engines intended for high performance, the extreme being for racing, have exhaust manifolds tuned to scavenge at high engine speeds, those used for towing heavy payloads or in heavily laden vehicles such as motor home coaches are designed to scavenge best at lower engine speeds with an emphasis on increasing engine torque output.

With a greater number of passages entering the collector as in larger engines with more cylinders, the area of the inlet face of the collector will increase. The center space, or void, Within the circle of primary passages also becomes greater. The passages are further displaced from a common center line and, if other dimensions remain equal, the collector volume increases. It becomes increasing difficult to manufacture a low volume collector for an 8, 10 or 12 cylinder engine to be used at lower operating speeds for towing or in heavy recreational vehicles. These engines are usually configured with two banks of cylinders forming a "V". Each bank of cylinders is served by manifold having a primary passage for each cylinder exiting into a common collector that feeds into an exhaust outlet system. Thus a V-10 engine would have two collectors, each connected to five primary pipes. Traditionally, efforts have been focused on exhaust passage length and diameter to promote exhaust scavenging. These two parameters will influence the engine speed range at which the scavenging efforts are most pronounced. Tuning the primary passage lengths and diameters for a specific engine speed range is common practice in the industry producing tubular exhaust manifolds, also known as headers.

The design of collectors has also been employed to enhance scavenging. By reducing the length of the collector, volume is reduced and the flow pressure pulses will have a stronger influence on other primary exhaust passages. This can only be carried on to a point, beyond which the collector sides create such a sharp angle that the collector begins to become a resistance to flow. As mentioned above, the collector is typically scalloped to conform to the exhaust passages, which reduces volume within the collector. The arrangement of the outlets of the exhaust passages bundled in a circle also reduces the volume of the collector.

SUMMARY OF THE INVENTION

The invention is directed to an exhaust scavenging system for an internal combustion engine. Exhaust passages extend from the engine and include outlets bundled substantially at an outlet plane. A collector includes an inlet portion extending about the bundled exhaust passages, an outlet portion configured to interface with the singular pipe of an exhaust outlet system and a transition portion there between defining a flow transition between the inlet and outlet portions. One or more exhaust passages centrally located in the bundle of exhaust passages extends through the outlet plane to operate as a flow enhancement element which extends into the transition portion of the collector.

Accordingly, it is an object of the present invention to provide an improved exhaust scavenging system for an internal combustion engine. Other and further objects and advantages will appear hereinafter.

DETAILED DESCRIPTION OF THE PREFERRED EMBODIMENTS

Figure 1:
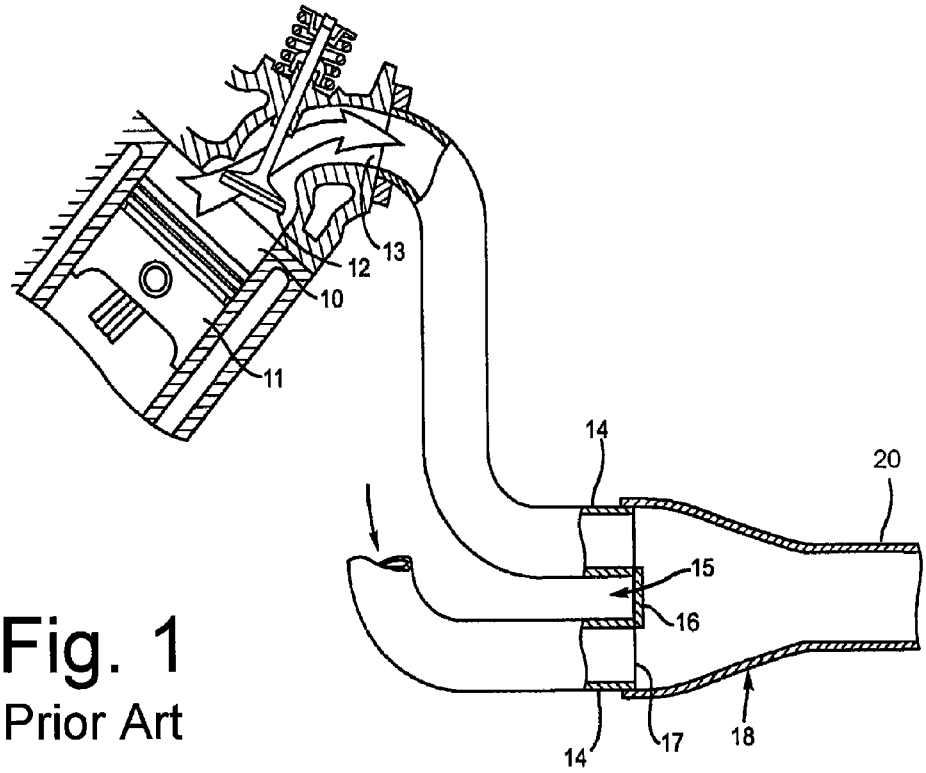
Fig. 1 Prior Art
FIG. 1 is a side view partially cross sectioned illustrating a prior art exhaust scavenging system.
Figure 2:
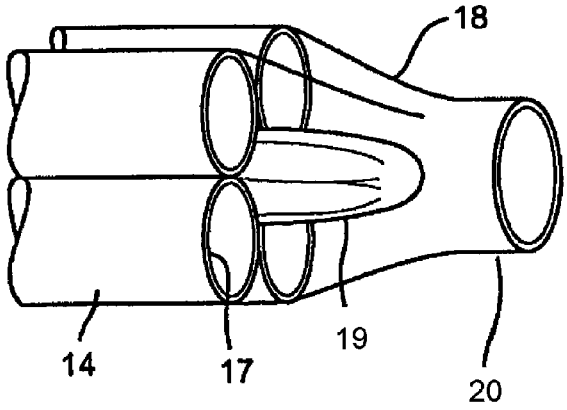
Fig. 2 Prior Art
FIG. 2 is a perspective view of another prior art exhaust scavenging system.
Figure 3:
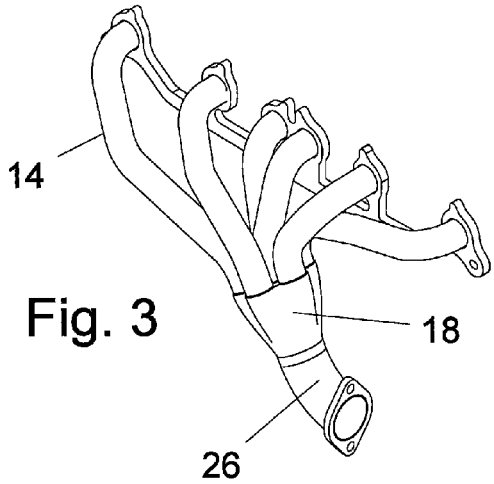
FIG. 3 is a perspective view of an exhaust manifold assembly.
Figure 6:
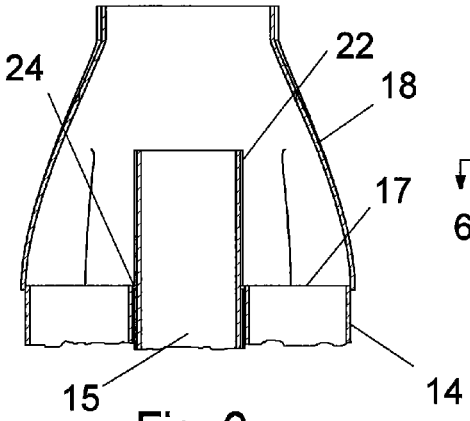
FIG. 6 is a cross-sectional view taken along line 6-6 of FIG. 5.
Figure 5:
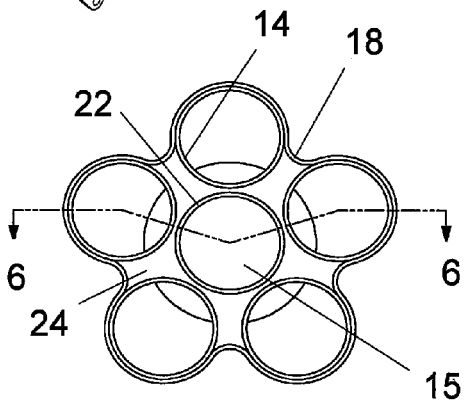
FIG. 5 is an end view of the collector of FIG. 2 taken on the exhaust passage end.
Figure 7:
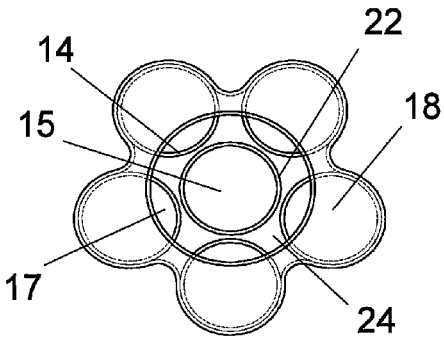
FIG. 7 is an end view of the collector of FIG. 2 taken on the header elbow end.
Figure 4:
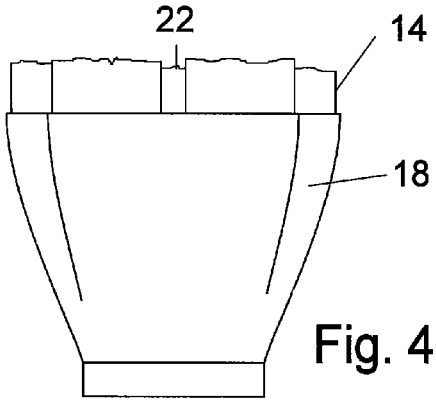
FIG. 4 is a side view of a collector with exhaust passages extending thereto.

FIGS. 1 and 2 illustrate systems known prior to the present invention. A cylinder 10 of a bank of cylinders includes a reciprocating piston 11, an exhaust valve 12 and the exhaust port 13. Two exhaust passages 14 are illustrated in a system which would include a bundling of three or more such passages from the cylinder bank. With the exhaust passages 14 typically bundled such that they are arranged in a circle equidistant from a common centerline, a center space 15 is defined between the passages 14 about which the exhaust passages 14 are equiangularly spaced. In the prior art, a plate 16 is typically welded over the center space to seal the inner periphery defined by the arranged passage bundle. The outlets 17 of the exhaust passages 14 lie in an outlet plane effectively including the plate 16. In FIG. 2, a flow enhancement element 19 replaces the plate 16.

The end of the exhaust passage bundle at the outlets 17 is shown to be enclosed by a collector 18. The collector 18 includes an inlet collector portion extending about the exhaust passages at the outlet plane in sealed arrangement at the periphery of the bundle. The shape of the collector 18 in cross section in this inlet collector portion includes lobes to fit about each of the passages 14. The shape may otherwise be described as scalloped. An outlet collector portion of the collector 18 provides an interface with a singular pipe 20 of an exhaust outlet system. The outlet system is shown in this illustrative embodiment to be integral with the collector 18. A flanged joint may be employed at any point there along.

A transition collector portion between the inlet and outlet collector portions provides flow transition between the two cross-sectional shapes and sizes. The cross-section shape typically progresses from the scalloped periphery to a circular periphery. Both ends of the conduit are sealed with the associated system so as to prevent exhaust leakage. Typically the total cross-sectional passage area of the collector 18 at the passages 14 is greater than at the interface with the exhaust outlet system. The flow transition through the transition collector portion is smooth with cross-sectional flow area continuously decreasing.

Turning to the first embodiment, FIGS. 3 through 7 employ the configuration of the prior systems of FIGS. 1 and 2. Further, a central exhaust passage 22 of the exhaust passages 14 extends into the collector 18 beyond the outlet plane defined by the outlets 17 from the center space 15. The central exhaust passage 22, as well as the remaining exhaust passages 14, is shown to be circular in this embodiment. A plate 24 seals the exhaust passage end of the collector 18 at the outlet plane defined by the outlets 17. A header elbow 26 is welded to the output end of the collector 18 to then be attached the exhaust system by a flange 28. The exhaust passages 14 may be arranged to be of tuned length or lengths empirically determined as correlated with optimal RPM. The cylinder firing order and the corresponding positions of the outlets 17 in the tube bundle at the outlet plane may be arranged to send exhaust pulses in sequence around the annular ring of outlets 17 in the inlet portion of the collector 18.

The central exhaust passage 22 is shown to extend through a portion of the transition portion of the collector 18 along a common centerline with a constant diameter. The cross sectional area through the collector 18 from the outlet plane defined by the outlets 17 decreases to the outlet of the collector 18. This decrease is not as pronounced at the exhaust passage end of the collector 18 as the scallops continuously decrease toward a circular cross section in the transition portion of the collector 18. The length of the central exhaust passage 22 extending beyond the outlet plane defined by the outlets 17 into the transition zone is established empirically for each engine.

Figure 9:
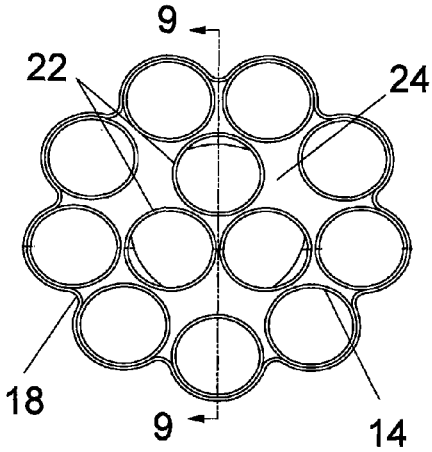
FIG. 9 is a cross-sectional view of the second embodiment taken along line 9-9 of FIG. 8.
Figure 8:
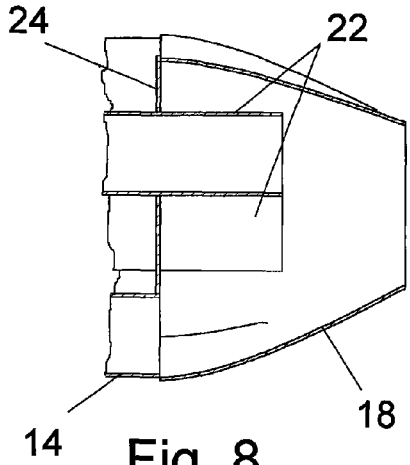
FIG. 8 is an end view of the collector of a second embodiment taken on the exhaust passage end.
Figure 10:
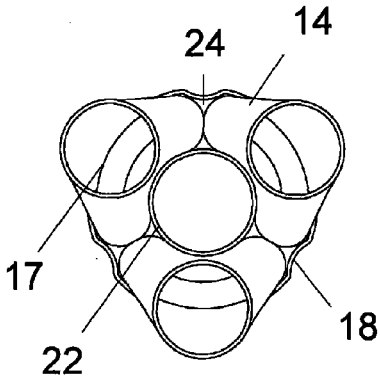
FIG. 10 is an end view of the collector of a third embodiment taken on the exhaust passage end.
Figure 12:
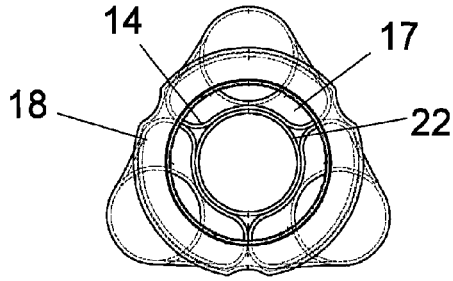
FIG. 12 is an end view of the collector of the third embodiment taken on the header elbow end.
Figure 11:
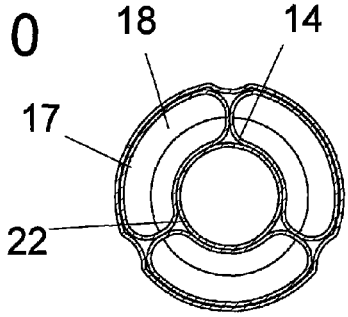
FIG. 11 is a cross-sectional view of the third embodiment taken at the outlet plane.

FIGS. 8 and 9 illustrate another possible embodiment. In this embodiment, multiple central passages 22 extend beyond the outlet plane defined by the outlets 17 into the transition zone. FIGS. 10 through 12 illustrate yet another possible embodiment. In this embodiment, the ends of the exhaust passages 14 are formed to better conform to the annular space around the central passage 22 inwardly of the wall of the collector 18. In a further embodiment, the single or multiple central passages 22 may be configured to provide a nozzle to increase velocity of the flow therefrom.

Figure 13:
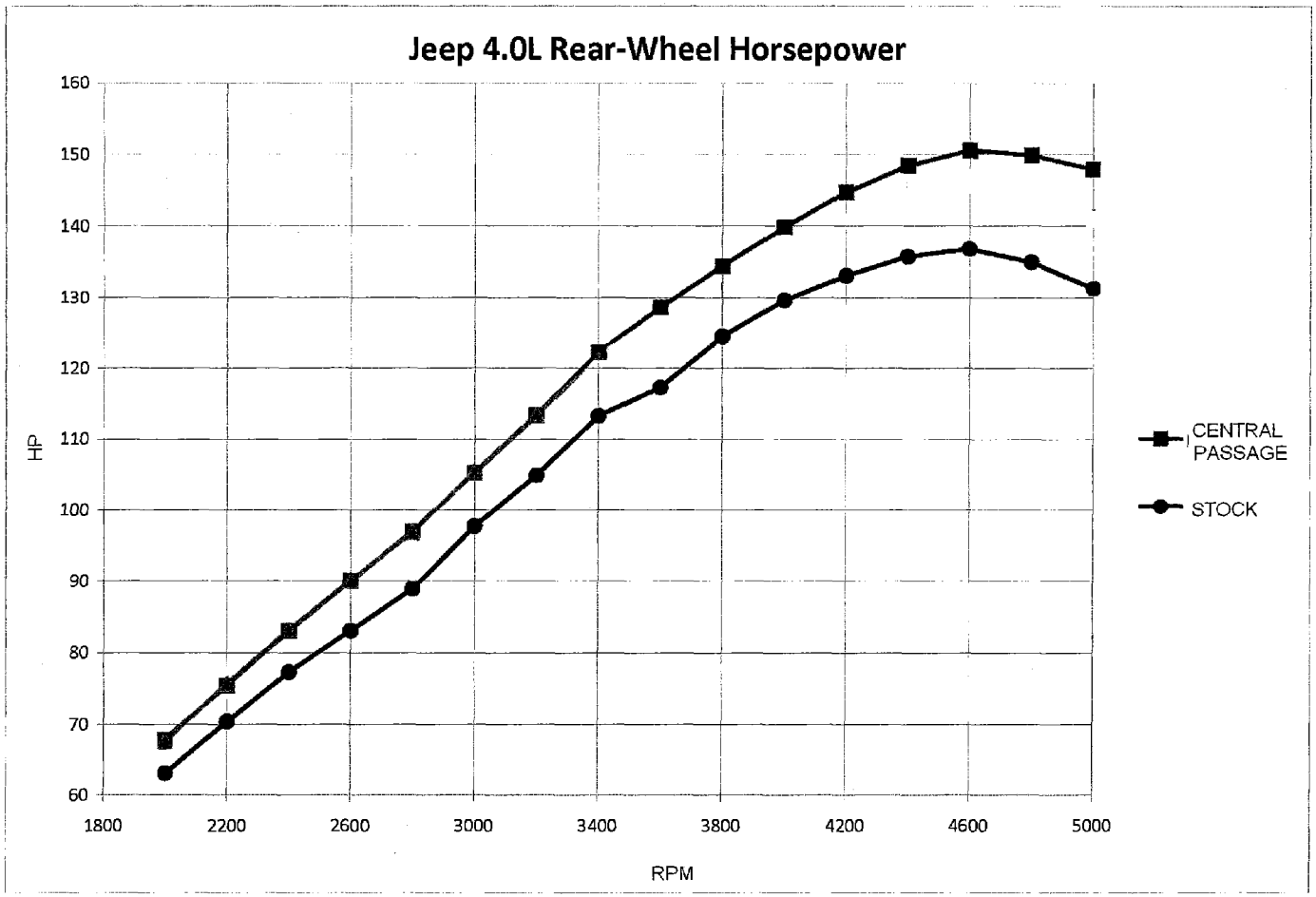
FIG. 13 is a graph of RPM vs. horsepower at the rear wheels for a Jeep 4L six cylinder engine.
Figure 14:
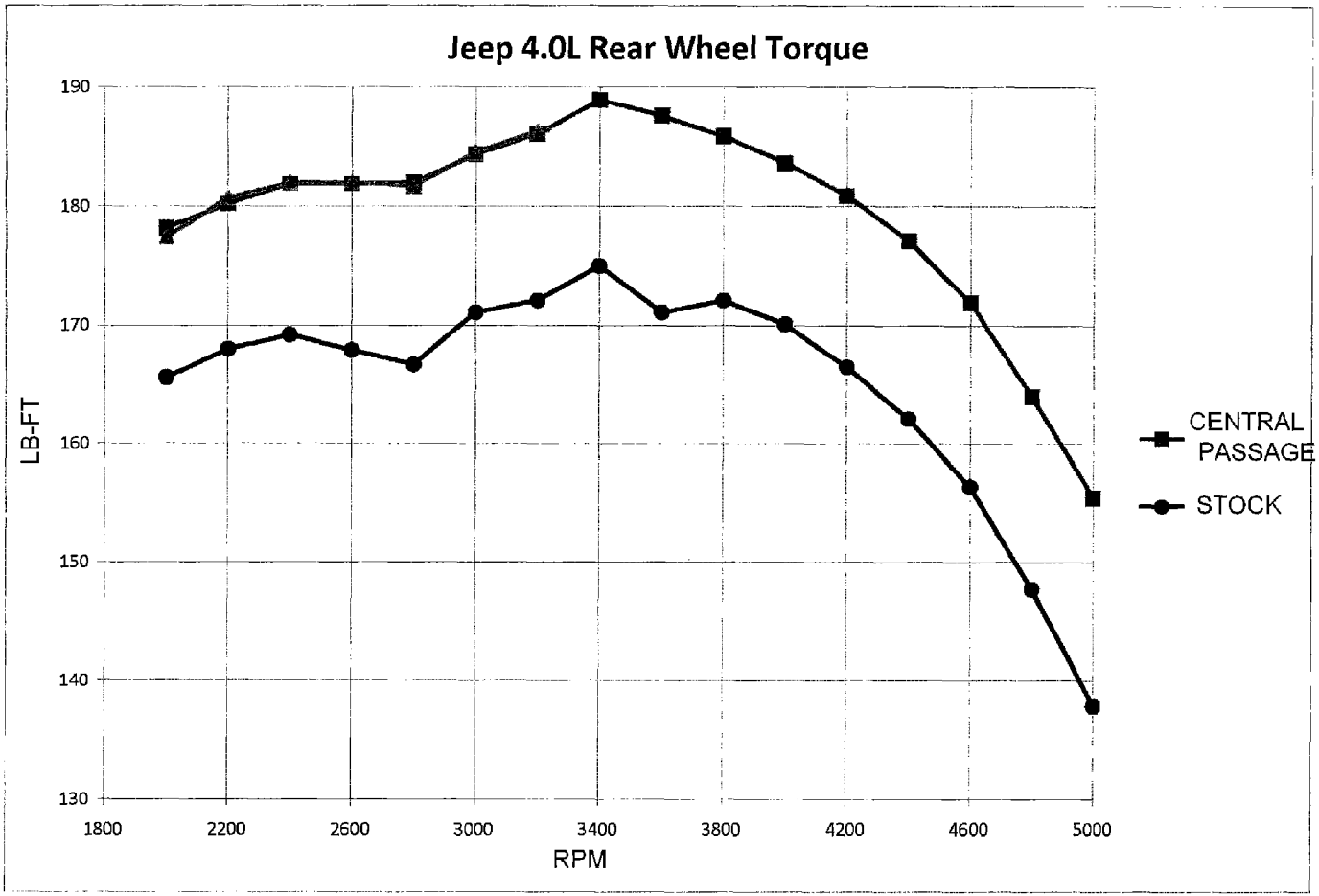
FIG. 14 is a graph of RPM vs. LB-FT of torque at the rear wheels for a Jeep 4L six cylinder engine.

The performance curves obtained for the device illustrated in the first embodiment are presented in FIGS. 13 and 14 for horsepower and torque, respectively. The performance curves for the stock vehicle are also given. The test vehicle is otherwise the same for comparison purposes.

Thus, an improved exhaust scavenging system has been disclosed. While embodiments and applications of this invention have been shown and described, it would be apparent to those skilled in the art that many more modifications are possible without departing from the inventive concepts herein. The invention, therefore is not to be restricted except in the spirit of the appended claims

What is claimed is:

1. An exhaust scavenging system for an internal combustion engine for directing exhaust gasses to a singular exhaust pipe, comprising at least three exhaust passages extending from the engine, each including an outlet, the outlets being equidistant from a common center line and terminating substantially in an outlet plane, the exhaust passage outlets defining a center space there among;

a collector having an inlet collector portion configured to interface with and extend about the exhaust passages at the outlet plane in sealed arrangement, an outlet collector portion configured to interface with the singular pipe and a transition collector portion providing flow transition between the inlet and outlet collector portions; and a central exhaust passage extending from the engine through the center space beyond the outlet plane into the transition collector portion.

2. The exhaust scavenging system for an internal combustion engine of claim 1 further comprising a plurality of said central exhaust passage.

3. The exhaust scavenging system for an internal combustion engine of claim 1, the exhaust passages being equiangularly spaced about the common center line.

4. The exhaust scavenging system for an internal combustion engine of claim 1, the transition collector portion defining a smooth flow transition between the inlet and outlet collector portions.

5. The exhaust scavenging system for an internal combustion engine of claim 1, the transition collector portion thereabout defining a cross-sectional flow area continuously decreasing from the inlet collector portion to the outlet collector portion.

* * * * *